United States Patent [19]

DeFay, Jr.

[11] 4,398,407

[45] Aug. 16, 1983

[54] SIZING OF POWDER METAL PARTS

[75] Inventor: Paul T. DeFay, Jr., Aurora, Ill.

[73] Assignee: AMSTED Industries Incorporated, Chicago, Ill.

[21] Appl. No.: 228,300

[22] Filed: Jan. 26, 1981

[51] Int. Cl.[3] ..... B21B 3/06; B21D 1/02; B21D 3/02

[52] U.S. Cl. ..... 72/75; 29/90 R; 419/28; 72/126; 72/112; 72/113; 72/117

[58] Field of Search ..... 29/90 R, 90 B, 90 A, 29/90.1, 90.2, 90.3, 90.5, 420.5, 420; 72/75, 126, 112, 113, 117; 419/28

[56] References Cited

U.S. PATENT DOCUMENTS

| | | | |
|---|---|---|---|
| 1,240,791 | 9/1917 | Czajka | 72/75 |
| 1,582,525 | 4/1926 | Lucas | 72/126 |
| 2,609,858 | 9/1952 | Engel | 72/112 |
| 4,059,879 | 11/1977 | Chmura et al. | 29/420.5 |

FOREIGN PATENT DOCUMENTS

| | | | |
|---|---|---|---|
| 864792 | 5/1941 | France | 72/112 |
| 516520 | 1/1940 | United Kingdom | 72/112 |

*Primary Examiner*—Francis S. Husar
*Assistant Examiner*—V. K. Rising
*Attorney, Agent, or Firm*—Edward J. Brosius; Fred P. Kostka

[57] ABSTRACT

Powder metal first pressed into a green briquette having an inner cavity is then sintered to form a rigid part. The inner cavity of the part is next sized in a lap-like operation by a spherical-shaped tool. The tool is rotated in an orbital pattern comprising a series of elliptically-shaped cycles. As the tool rotates, small successive portions of a surface of the cavity are contacted by the tool. This lap-like interaction between the tool and cavity surface not only sizes the cavity to an exact dimension but improves the wear quality of the cavity surface by increasing the density of a wall of the cavity as well as providing an improved surface finish.

3 Claims, 4 Drawing Figures

SIZING OF POWDER METAL PARTS

BACKGROUND OF THE INVENTION

1. Field of the Invention

This invention relates to methods of metal forming and more particularly to a method for sizing powder metal parts.

2. Prior Art

Fabrication of powder metal parts is well known. This fabrication technique allows parts having intricate configurations to be produced without the need for expensive machining and other such operations.

A mixture of metal powders is loaded into a die having a shape of the part. The metal powders are then compacted with a punch into a green briquette having a substantially finalized shape. Next, the part is sintered in a protective atmosphere wherein the powders are heated and joined into a solid mass. Density of such parts may typically vary from 75 to 95 percent.

Parts having a reduced density may be infiltrated with a further material, for example copper, where the part is to be used as a bearing. Lastly, the part may be tumbled to remove burrs.

Where the part is to have an inner cavity, the cavity may be formed with the die during compacting of the powders. Without additional processing, the cavity can be so made within a dimensional tolerance of ±0.005, for example. Where the dimensional tolerance of the cavity must be ±0.001, an additional operation is required. To obtain this improved dimensional control, the cavity may be cold balled wherein a surface of the cavity is impacted by a tool having an outer dimension substantially equal to the cavity dimension sought. Cold balling is regulated to produce stress substantially equal to the yield point of the cavity wall to produce some permanent deformation. However, because portions of the wall are subject to stresses less than the yield point, the wall is in part merely deflected and returns to its prior configuration. Cold balling, while heretofore considered the most economical means for sizing the part cavity to the dimension sought, nevertheless produces a substantial number of out-of-tolerance parts.

SUMMARY OF THE INVENTION

A powder metal part is made by first loading a die having a selectively formed configuration with a mixture of powders. The mixture primarily comprises a ferrous powder and may include small quantities of alloying powders such as carbon, manganese and phosphorus. The powders are then compacted with a punch to produce a green briquette having a configuration complementary to the die. Where the part is to have an inner cavity, the cavity may be formed by the punch concurrently with the compaction of the powders. Such a cavity may have, for example, a cylindrical or spherical configuration depending upon its intended purpose.

The part is then sintered in a protective atmosphere to inhibit oxidation and enhance metallurgical properties of the part. Afterwards the part may be infiltrated with copper or a lubricant again depending on part use.

To size the inner cavity to an exacting tolerance, the part is placed in a holding fixture. The fixture is associated with a machine which rotates an attached tool in an orbital pattern formed by a series of elliptically-shaped cycles. As the tool is rotated in this selective pattern, it is lowered into the part inner cavity. During each rotational cycle, the tool successively engages small adjacent portions of a wall of the cavity to cause a slight deformation of the wall surface. With completion of one orbit, the tool has moved once about the entire cavity surface. After a selectively short time period, the tool is withdrawn leaving the inner cavity properly sized to a tolerance of ±0.001 inch, for example.

Sizing of a powder metal part as described above provides certain advantages over previously known methods of sizing.

First, proximately 15 percent more parts may be sized in an equal time period.

Secondly, the percentage of rejection is reduced from 15 to less than 1 percent. Note that producing in-tolerance parts in the first place substantially reduces the need for reworking and further inspection as well as scrap. The net result is twofold in that higher quality parts may be produced more economically.

A further advantage is that the smoothness of the cavity wall surface is enhanced. The orbiting tool levels areas of raised metal into depressed areas producing a more uniform surface having an improved surface finish.

Lastly, the wear qualities of the cavity wall are increased because engagement of the tool with the cavity wall results in a uniform deformation of the wall which increases its average density.

DESCRIPTION OF THE PREFERRED EMBODIMENT

Figure 1:
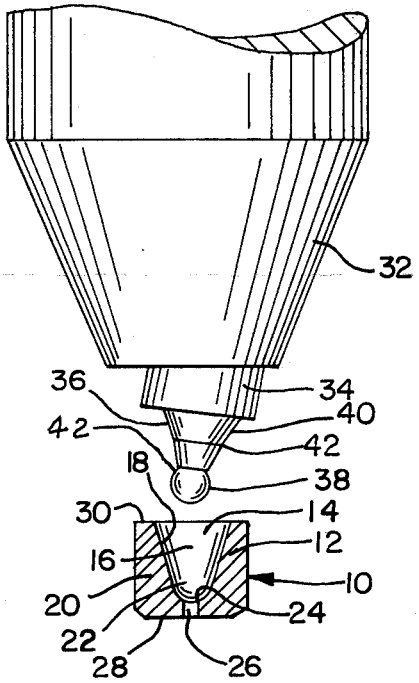
FIG. 1 is a side elevational view of an orbiting-type tool positioned above a part having an inner cavity to be sized.
Figure 2:
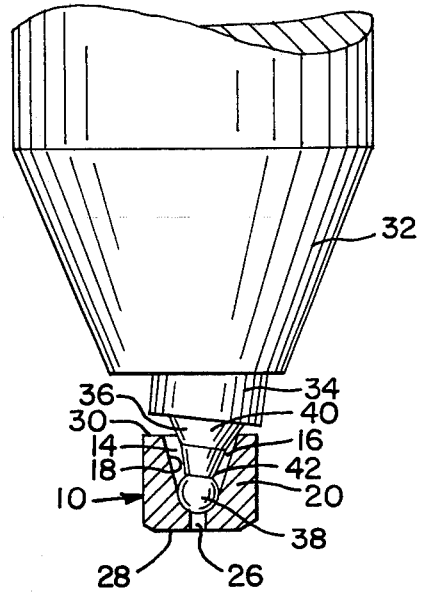
FIG. 2 is similar to FIG. 1 except that the orbiting tool has been lowered into the part inner cavity.
Figure 3:
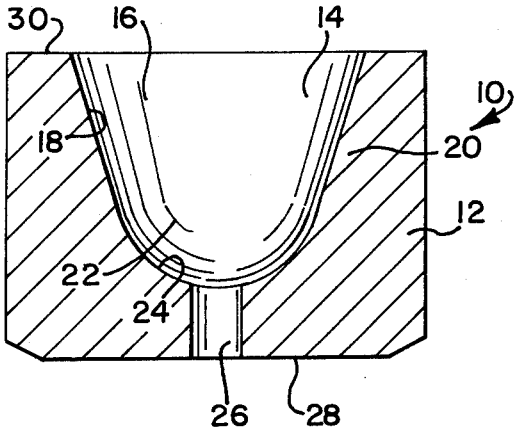
FIG. 3 is an elevational, cross-sectional view of a typical powder metal part having an inner cavity which may be sized by this inventive method.

A powder metal part is shown generally and designated 10. The part 10 may be made in a number of configurations and as shown has a cylindrical-shaped body 12. This body 12 is produced by placing a mixture of metal powders in a die having the configuration complementary to the part 10 and then compacting the powders with a punch. The punch may include a penetrating portion where the part body 12 is to have an inner cavity 14. After compacting, the part is sintered.

The inner cavity 14 has an upper portion 16 defined by a downwardly conically-shaped surface 18 which interfaces between the cavity 14 and a sidewall 20 of the cavity 14. The cavity upper portion 14 connects with a middle spherical portion 22 defined by a spherical surface 24. The middle spherical portion 22 in turn connects with a lower cylindrical-shaped passage 26. The passage 26 intersects with a bottom surface 28 of the part 10 while the upper portion 16 intersects with a top surface 30 of the part 10.

To size the spherical portion 22 of the part inner cavity 14, the part 10 is placed under an orbital drive head 32 having a chuck 34 which carries a tool 36. The tool 36 has a spherical-shaped ball head 38 which is proximately 0.003 inch oversized to allow the head 38 to penetrate with a slight forced fit into the inner cavity spherical portion 22. The tool 36 is further defined by a stepped conically-shaped shank 40 which connects with the head 38.

The stepped configuration of the shank 40 provides undercuts 42 which allow the tool head 38 to be lowered into the cavity 14 to contact the spherical portion surface 24 of the part cavity 14 while at the same time avoiding contact between the tool shank 40 and the part 10.

It should be understood that when the cavity 14 of the part 10 is being sized, the part 10 is held in a fixture (not shown) in a known manner. Placement and removal of the part 10 in this fixture may be done manually or with mechanical means. Where the number of parts 10 to be sized is large, the preferred production procedure is to minimize manual input for part placement and removal.

Figure 4:
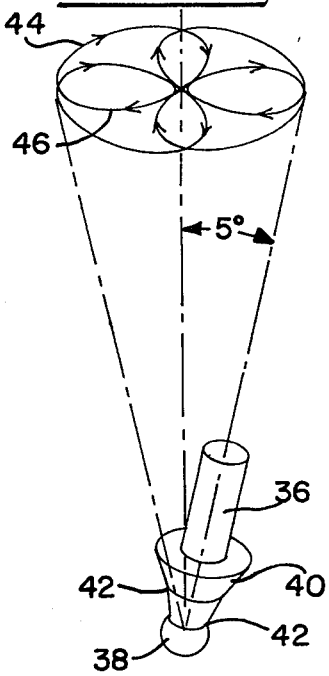
FIG. 4 is a perspective view which depicts a typical orbital pattern of the tool of FIGS. 1 and 2.

As best seen in FIG. 4, the tool 36 operates in an orbital pattern 44 comprising a series of rotational and in this case elliptical cycles 46. As the tool 36 rotates in these cycles 46, the tool 32 moves circumferentially about the cavity 14. In this manner, the tool ball head 38 comes into contact with substantially the entire surface 24 of the spherical portion 22 of the part cavity 14.

As the tool ball head 38 works its way about the cavity spherical portion surface 24, the ball head 38 interacts with the surface 24 to level high spots, i.e. raised areas of metal, in the surface 24 and smooths such into low spots, i.e. areas of depression, in the surface 24. This surface smoothing is comparable to lapping without a loss of material. The smoothing process not only produces a more uniform surface having an improved surface finish, but also compacts the sintered powder of the surface 24. This compacting increases the density of the cavity sidewall 20 from 5 to 10 percent. Upon withdrawal of the tool 36 from the cavity 14, the spherical portion 22 is sized to a dimension having a tolerance of ±0.001 inch.

It should be understood that the sizing procedure described above is not limited to an inner spherical cavity but could be used to size any number of part surfaces having a radiused configuration. To allow the tool 36 to be operated in the elliptical cycles 46, a longitudinal axis of the tool 36 and the chuck 34 are angularly offset proximately 5 degrees from a vertical axis of the drive head 32. These two axes intersect at a center point about which the spherical tool ball head 38 is formed. The amount of deformation produced by the tool ball head 38 in the part surface 24 is proportional to the degree of angularity at which the tool 36 is set.

Engagement between the tool ball head 38 and the part 10 lasts for proximately 0.7 seconds. The total cycle time for sizing each part 10 is proximately 1.5 seconds using mechanical means for delivering and removing the part 10 to and from the holding fixture.

While various modifications may be suggested by those versed in the art, it should be understood that I wish to embody within the scope of the patent warranted hereon all such modifications as reasonably and properly come within the scope of my contribution to the art.

What is claimed is:

1. A method of sizing a generally spherical surface formed in the base of a cavity having raised areas provided in a powder metal part, said method comprising (a) applying a deforming pressure against the base of said cavity with a member having a substantially spherical surface, and (b) uninterruptedly rotating said member in a series of overlapping and different substantially elliptical orbital paths to cause deformation of said raised areas in said cavity spherical surface and displacement of raised portions of metal into depressions until said cavity base is smooth.

2. The method as defined in claim 1 including the step of compacting said cavity spherical surface with said member spherical surface to increase the density of said cavity base.

3. The method as defined in claim 2 including the step of lapping said spherical surface.

* * * * *